US006264243B1

(12) United States Patent
Zetschick

(10) Patent No.: US 6,264,243 B1
(45) Date of Patent: Jul. 24, 2001

(54) COMBINATION OF PRINTED MATTER, IN THE FORM OF A BROCHURE, AND A HOLDER

(75) Inventor: Kay-Michael Zetschick, Wyk auf Föhr (DE)

(73) Assignee: Inseljournale GmbH & Co., KGi.G., Wyk auf Fohr (DE)

( * ) Notice: Subject to any disclaimer, the term of this patent is extended or adjusted under 35 U.S.C. 154(b) by 0 days.

(21) Appl. No.: 09/180,119

(22) PCT Filed: Apr. 30, 1997

(86) PCT No.: PCT/EP97/02227

§ 371 Date: Jul. 21, 1999

§ 102(e) Date: Jul. 21, 1999

(87) PCT Pub. No.: WO97/42037

PCT Pub. Date: Nov. 13, 1997

(30) Foreign Application Priority Data

May 2, 1996 (DE) ..... 296 07 958 U

(51) Int. Cl.[7] ..... B42D 3/00

(52) U.S. Cl. ..... 281/33; 40/124.01; 40/124.06; 281/29; 283/33; 402/4

(58) Field of Search ..... 281/33, 51, 37, 281/36, 29; 248/451, 462; 402/4, 80 R; 40/124.01, 124.06; 283/33

(56) References Cited

U.S. PATENT DOCUMENTS

| | | | | |
|---|---|---|---|---|
| 2,255,535 | * | 9/1941 | Sauer | 40/124.01 |
| 3,474,554 | * | 10/1969 | Des Ormeaux | 40/102 |
| 4,609,206 | * | 9/1986 | O'Brien | 281/33 |
| 5,044,594 | * | 9/1991 | Hegarty | 248/454 |
| 5,921,579 | * | 7/1999 | Sadler | 281/33 |

* cited by examiner

*Primary Examiner*—A. L. Wellington
*Assistant Examiner*—Monica Carter
(74) *Attorney, Agent, or Firm*—Vidas, Arrett & Steinkraus, P.A.

(57) ABSTRACT

A combination of a brochure-like printed product and a holder formed as a stand element which stands independently on an underlay and on which the printed product with the back may be so attached that it is held in the upright position by the stand element.

15 Claims, 1 Drawing Sheet

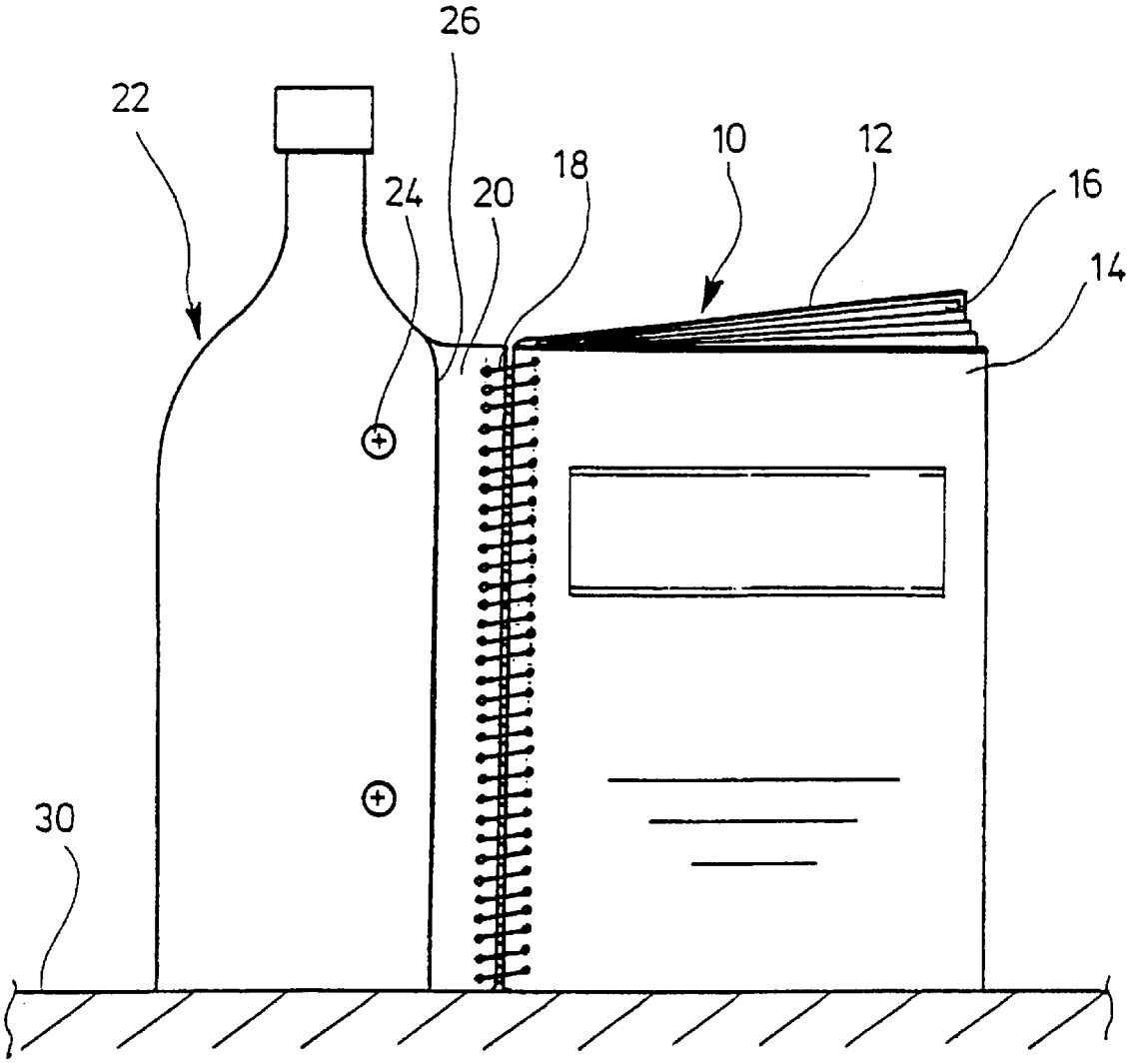
26
22
10
12
18
24
20
16
14
30

COMBINATION OF PRINTED MATTER, IN THE FORM OF A BROCHURE, AND A HOLDER

BACKGROUND OF THE INVENTION

The invention relates to a combination of a brochure-like printed product and a holder.

It is known to hold magazines and newspapers with the help of holders consisting of two ledges which can be screwed to one another in a clamping manner. Such holders on the one hand serve to hang up the magazines and newspapers and on the other hand simplify the reading, in particular with large format papers.

It is further also known for the purpose of presentation and space-favourable keeping to deposit means and/or drinks list on an underlay, such as a table, by way of suitable holders. The menus are mostly clampingly accommodated by the holder. For their use they must be removed from the holder. It is often the job of the waiter to place used menus back into the holder, which entails a certain effort.

Apart from this with particularly attractively formed menus or those provided with additional interesting information there is the danger that they are taken by the guests. This danger is particularly large with restaurant businesses which have a large turnover, for example also on ferries or likewise.

It is further already known to open menus in the manner of a journal which contains additional information. On ferries such journals may for example contain information and useful indications on the destinations being travelled to. Furthermore there exists the possibility of providing such brochure-like menus and drinks lists with advertisings. With such journal-like menus the danger is particularly great that they are taken by guests. Although this danger may be reduced by way of the collecting up by the waiter after the selection of meals and drinks, with a heavily frequented restaurant business this however entails an unacceptably high effort.

It is the object of the invention to provide a combination of a brochure-like printed product and a holder, which on the one hand permits a pleasant presentation of the printed product and on the other hand excludes a taking away.

BRIEF SUMMARY OF THE INVENTION

With the combination according to the invention there is provided a stand element which independently stands on an underlay. The printed product, for example a journal-like menu and drinks list, is so attached with the back on the stand element that it is held by the stand element in an upright position. Preferably the printed product with the lower edge likewise stands on the underway, wherein according to a further formation of the invention it may comprise a relatively stiff cover so that in the upright position it at least keeps its shape to the greatest possible extent. Also the pages of the printed product are preferably formed from relatively stiff paper so that the whole printed product standing retains its position and may be comfortably handled.

The stand element has a sufficient weight in order to maintain its upright position together with the held printed product given shakings and swayings as roughly arise on ferries. On the other hand it is shaped such that it may also be grasped by the hand and may be comfortably held on reading the printed product.

For the formation of the printed product and the design of the attachment various formation possibilities are conceivable. The attachment of the printed product on the stand element according to one formation of the invention is effected via a linkage by which means the whole printed product as well as the individual pages may be adequately pivoted with respect to the stand element in order to permit a comfortable reading. In this context one further formation of the invention provides for the pages of the printed product to be held together by way of a ring binding and the linkage by way of a ring binder.

The ring binding may for example be connected to the stand element by way of a wire or a rod which is guided through the ring spirals. One embodiment of the invention provides for a narrow strip of a flexible sheet material to be connected to the back or the ring binding of the printed product and on the other side to be attached on the stand element. Preferably the strip is clamped into the stand element for example in a clamping slot provided for this. The stand element may be formed one-pieced from a suitable material such as plastic, wood, metal or likewise. It may however also be formed for example two-pieced in order to clamp in the printed product with its back. For this purpose it is necessary for example to clampingly assemble the halves of the stand element with the help of screws or likewise. It is however also conceivable to provide a separate clamping with the help of a clamping ledge for example which clamps the back of the printed product against a clamping surface of the stand element. With the application of a ring binding, as mentioned an intermediate element in the form of a strip is advantageous, which at one end cooperates with the ring binding and thus comprises a corresponding holing, and which at the other side is attached to the stand element for example by way of the described clamping. Preferably such a strip consists of flexible plastic material which may be transparent in order to form the arrangement more optically appealing.

The stand element is advantageously to be formed with a suitable gracefulness. At the same time it is advantageous when it is equipped with surfaces for advertising purposes, wherein the overprint is effected either directly on the advertisment carrier or with paper or plastic foil which is then stuck on. Furthermore the stand element may imitate characteristic objects, for example a bottle. It may be a typical bottle shape of a known drink. If a bottle shape is used which also offers the advantage of comfortable handling, then in the belly region is it provided preferably with a flat region so that the printed product may be more simply attached.

The stand element usefully has at least the height of the printed product to be held. It may also upwardly project over the printed product to a greater or lesser degree. On the one hand the height is only to be selected as high as is absolutely necessary for holding purposes. On the other hand a too large a height impedes the stability and also the optical impression.

The formation according to the invention permits an optically appealing presentation of a printed product, in particular of a brochure-like menu (journal) combined with advertising and information by way of a secure arrangement on an underlay with the help of a stand element on which the printed product is linked. The stand element may for its part be used for advertising purposes and does not inhibit the handling on reading the printed product. On the other hand it counteracts an undesired taking away.

BRIEF DESCRIPTION OF THE SEVERAL VIEWS OF THE DRAWING

The invention is hereinafter described in more detail by way of a drawing.

The single FIGURE shows the combination according to the invention in a lateral view.

DETAILED DESCRIPTION OF THE INVENTION

In the drawing there can be recognized a brochure-like printed product 10 which comprises a relatively stiff covers 12, 14, for example of a plastic material and pages 16 between, which are manufactured of relatively stiff paper. The pages 16 and the lid 12, 14 are held together by way of a ring binding 18, which for example consists of a plastic spiral. The product 10 is for example formed as a drinks menu, wherein additional pages contain information and advertising, for example with respect to the destinations which are travelled to with ferries. Accordingly the printed product is e.g. the menu for the restaurant business on a ferry.

Bound into the ring binding 18 is also a relatively narrow strip 20 of a transparent plastic material which is inserted into a non-shown slot of a bottle-shaped stand element 22. The strip 20 is fastened with the help of two screws 24. This fastening manner is however only shown by way of example. Other clamping and fastenings of the strip 20 in the stand element 22 are possible.

The stand element 22 which has a bottle-shape, but on one side at 26 is flattened for the purpose of attaching the strip 20, consists for example of plastic, wood, metal or likewise and may be hollow or solid. It is essential that it has a sufficient weight in order when stood on an underlay 30 to maintain the product 10 in the shown upright position. The product 10 is then supported with the lower edge likewise on the underlay. The stiffness of the covers 12, 14 sees to it that the printed product essentially retains its shape and thus effects an advantageous presentation.

What is claimed is:

1. A combination of a brochure-like printed product (10) and a holder (22) formed as a stand element which stands independently on an underlay (30) and on which the printed product (10) is attached so that it is held in an upright position by the stand element, wherein the printed product (10) is pivotally attached on the stand element and comprises relatively stiff covers in a manner such that in an upright position it largely keeps its shape and the printed product (10) is formed standing up on the underlay (30) when it is attached to the stand element, and wherein a narrow strip (20) of flexible sheet material is connected to a side of the printed product (10) and the other side is attached to the stand element (22).

2. A combination according to claim 1, characterized in that the printed product (10) includes a plurality of pages (16), and wherein the pages (16) of the printed product (10) are held together via a ring binding (18) and a linkage on the stand element (22) is effected via a ring binding (18).

3. A combination according to claim 1, characterized in that the strip (20) on the stand element (22) is clamped in.

4. A combination according to claim 3, characterized in that the stand element comprises a releasable clamping device for the strip.

5. A combination according to claim 1, characterized in that the stand element (22) is formed such that the stand may be comfortably grasped by the hand and held.

6. A combination according to claim 1, characterized in that the stand element (22) is formed as an advertisment carrier with an advertising surface on which one may print or adhere.

7. A combination according to claim 1, characterized in that the stand element (22) has the shape of a bottle.

8. A combination according to claim 7, characterized in that the bottle-shaped stand element has a flattening (26) parallel to the axis.

9. A combination according to claim 1, characterized in that the stand element (22) is formed of wood, plastic or metal.

10. A combination of a brochure-like printed product (10) and a holder (22) formed as a stand element which stands independently on an underlay (30) and on which the printed product (10) with a back side may be so attached that it is held in an upright position by the stand element (22), wherein the back of the printed product (10) is pivotally linked on the stand element (22) and via a narrow strip of flexible sheet material by way of a releasable clamping device is clamped rigidly on the stand element and between a strip (20) and the printed product (10) there is provided a ring binding (18).

11. A combination according to claim 10, characterized in that the printed product (10) is formed as standing up on the underlay (30).

12. A combination according to claim 10, characterized in that the printed product (10) comprises relatively stiff covers (12, 14) in a manner such that in an upright position they at least largely keep their shape.

13. A combination according to claim 10, characterized in that the pages (16) of the printed product (10) are manufactured of relatively stiff paper.

14. A combination according to claim 11, characterized in that the strip (20) consists of transparent plastic material.

15. A combination according to claim 11, characterized in that the strip (20) is received by a clamping slot of the stand element (22).

* * * * *